US010647554B2

(12) United States Patent
Oelberger et al.

(10) Patent No.: US 10,647,554 B2
(45) Date of Patent: May 12, 2020

(54) MOBILE CRANE

(71) Applicant: Liebherr-Werk Ehingen GmbH, Ehingen/Donau (DE)

(72) Inventors: Franz Oelberger, Senden (DE); Yggve Richter, Blaubeuren (DE); Markus Bitz, Laupheim (DE); Heinz Koenig, Biberach (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 411 days.

(21) Appl. No.: 15/078,635

(22) Filed: Mar. 23, 2016

(65) Prior Publication Data

US 2016/0280517 A1 Sep. 29, 2016

(30) Foreign Application Priority Data

Mar. 24, 2015 (DE) ..... 10 2015 003 818
May 18, 2015 (DE) ..... 10 2015 006 439

(51) Int. Cl.
*B66C 23/76* (2006.01)
*B66C 23/36* (2006.01)

(52) U.S. Cl.
CPC ..... *B66C 23/76* (2013.01); *B66C 23/36* (2013.01)

(58) Field of Classification Search
CPC ..... B66C 23/72; B66C 23/74; B66C 23/76; B66C 23/36; E02F 9/18; B62D 49/085
See application file for complete search history.

(56) References Cited

U.S. PATENT DOCUMENTS

| | | | | |
|---|---|---|---|---|
| 2,693,250 A | 11/1954 | Barrett | | |
| 3,236,391 A | 2/1966 | Kennedy | | |
| 3,378,148 A | 4/1968 | Stanley | | |
| 5,586,667 A * | 12/1996 | Landry | B66C 23/76 | 212/195 |
| 5,941,401 A * | 8/1999 | Petzold | B66C 23/84 | 212/178 |
| 2006/0043042 A1* | 3/2006 | Kimura | B66C 23/74 | 212/178 |
| 2006/0103125 A1* | 5/2006 | Yamamoto | B62D 49/085 | 280/760 |
| 2010/0224583 A1* | 9/2010 | Mentink | B66C 23/74 | 212/175 |

(Continued)

FOREIGN PATENT DOCUMENTS

| | | |
|---|---|---|
| CN | 102229415 B | 7/2013 |
| DE | 102012011871 A1 | 12/2013 |

(Continued)

OTHER PUBLICATIONS

Machine Translation of EP-0,596,583 (1994).*

*Primary Examiner* — Michael R Mansen
*Assistant Examiner* — Juan J Campos, Jr.
(74) *Attorney, Agent, or Firm* — McCoy Russell LLP

(57) ABSTRACT

The invention concerns a mobile crane with a drivable undercarriage and a rotatable superstructure mounted thereon, where on the one side there is pivoted a swiveling jib, and on the other side a counterweight arrangement is mounted which is movable relative to the superstructure. According to the invention, the counterweight arrangement has a counterweight base plate, on which at least two stacks of counterweights are arranged and able to swivel about a vertical axis.

15 Claims, 10 Drawing Sheets

(56) References Cited

U.S. PATENT DOCUMENTS

| | | | | |
|---|---|---|---|---|
| 2011/0031202 | A1* | 2/2011 | Pech | B66C 23/76 212/178 |
| 2011/0031728 | A1* | 2/2011 | Arzberger | B66C 23/74 280/755 |
| 2012/0160795 | A1* | 6/2012 | Liu | B66C 23/74 212/178 |

FOREIGN PATENT DOCUMENTS

| | | | | |
|---|---|---|---|---|
| DE | 102012006494 | B4 | 3/2014 | |
| EP | 0596583 | A1 * | 5/1994 | B66C 23/50 |
| EP | 2657176 | A1 | 10/2013 | |
| SU | 749792 | A1 * | 7/1980 | B66C 23/74 |
| WO | 2013000322 | A1 | 1/2013 | |

* cited by examiner

MOBILE CRANE

CROSS REFERENCE TO RELATED APPLICATIONS

The present application claims priority to German Patent Application No. 10 2015 003 818.4, filed Mar. 24, 2015, and to German Patent Application No. 10 2015 006 439.8, filed on May 18, 2015 the entire contents of each of which are hereby incorporated by reference in their entirety for all purposes.

TECHNICAL FIELD

The invention concerns a mobile crane with a drivable undercarriage and a rotatable superstructure mounted thereon, where on the one side there is pivoted a swiveling jib, and on the other side a counterweight arrangement is mounted which is movable relative to the superstructure.

BACKGROUND AND SUMMARY

Mobile cranes are already known in which the counterweight arrangement is disposed movably to the superstructure in order to increase or decrease the counter-torque. Thus, for example, a mobile crane is specified in DE 10 2012 006 494 B4, in which the counterweight arrangement can be shifted in linear fashion along the lengthwise axis of the superstructure in order to increase or decrease the counter-torque. The position of the counterweight arrangement can be adapted mechanically to the tilt angle of the jib by a coupling mechanism, which can also be optionally decoupled once again.

A counterweight arrangement which is arranged movably on the superstructure is known from CN 102229415 B, which can be moved in linear manner along the superstructure via corresponding piston and cylinder arrangements to increase or decrease the counter-torque.

If, now, the counterweight arrangement is shifted backward by the corresponding piston and cylinder arrangement of the coupling rod to increase the counter-torque, the swivel radius of the superstructure automatically increases. At construction sites with narrow space available, this can cause problems with interfering edges, such as those of building walls or other interfering structures.

The problem which the present invention proposes to solve is to modify a mobile crane of the mentioned kind so that the ballast radius can be adjusted in easy manner over the largest possible adjustment path, while at the same time the swivel radius of the superstructure is minimized as much as possible.

According to the invention, this problem is solved by a mobile crane with a drivable undercarriage and a rotatable superstructure mounted thereon, where on the one side there is pivoted a swiveling jib, and on the other side a counterweight arrangement is mounted which is movable relative to the superstructure. According to the invention, the counterweight arrangement has a counterweight base plate, on which at least two stacks of counterweights are arranged and able to swivel about a vertical axis. Thanks to the new concept of swiveling capability of the stack of counterweights, an easy adjustment of the ballast radius is possible by rotary movement, thereby achieving a large adjustment path.

Advantageous configurations of the invention will appear from the subsidiary claims connected to the main claim.

Accordingly, the counterweight base plate can be joined by a counterweight frame to the superstructure. This makes it possible to separate the entire counterweight arrangement when needed in easy fashion from the superstructure, for example, in order to be driven on its own transport vehicle during road traffic in order to decrease the base weight of the mobile crane.

According to another advantageous embodiment of the invention, the stacks of counterweights can be placed on swivel arms pivoting on the counterweight base plate, which can swivel continuously from a maximum retracted to a maximum extended position via swivel drive units, for example in the form of hydraulically operated piston and cylinder arrangements or electrically operated adjusting means. Such a swivel drive unit is necessary, since the bearing forces in the vertical swivel bearing are very large.

Especially advantageously, the counterweight plates which can be formed into the stacks of counterweights can have an essentially triangular shape. This makes it possible for the center of gravity of the movable parts of the counterweight arrangement to move further away from the axis of rotation of the superstructure about the undercarriage than the outermost point of the counterweight arrangement. Thus, the outermost point of the counterweight arrangement, forming the swivel radius of the superstructure and determining the space needed at the construction site, is increased less than the outwardly moved swivel point of the movable parts of the counterweight arrangement to generate the larger counter-torque.

Advantageously, the swivel angle of the swivel arms can be detected by sensors. Thus, the position of the swivel arms can be provided to the control unit. This is therefore able to take into account intermediate positions as well in the crane monitoring.

The adjustable ballast radius means in particular that the superstructure can rotate by 360° within the support base for a small ballast radius. It is of special benefit when the corresponding sensor signals can be fed to a corresponding crane controller which can carry out a method for the monitoring of crane safety in accordance with DE 10 2012 011 871 A1. Since the mobile crane can be set up with any desired support base, it can be operated close to interference edges at narrow construction sites, such as the walls of houses. Thanks to the swivel mechanism according to the invention, the counterweight base plates of the counterweight arrangement can be adjusted in very easy manner, so that the radius of turning of the superstructure can be adapted in easy manner to the interference edges.

If a very large counter-torque is needed, so that the stacks of counterweights would become too high, according to an especially advantageous configuration in the context of the invention one can also provide four stacks of counterweights, which are arranged to swivel about four vertical axes. In this way, the bearing forces on the vertical bearings can be lowered. Preferably, the two stacks of counterweights arranged alongside each other can be pivoted and coupled together, resulting in a kind of parallelogram guidance.

According to another advantageous embodiment of the invention, the counterweight arrangement consisting of the counterweight frame, the counterweight base plate, the swivel arms pivoting on the latter and optionally winch with cable and reeved pulley case laid down on the counterweight frame can be removed as a whole from the superstructure as a self-standing transport unit. This transport unit can then be loaded onto a semi truck provided especially for this for its transport. Especially advantageously, at least one counterweight plate is already placed on the counterweight arrangement for the transport. This then facilitates the assembly of the mobile crane, since the counterweight arrangement is already assembled with counterweight plate placed on the superstructure.

According to one alternative advantageous embodiment, in the case when the counterweight arrangement remains on the superstructure during the road transport, a base plate arranged on the swivel arms to receive the counterweight plates can be taken off and fastened on the mobile crane. This alternative embodiment is designed for mobile cranes which can travel with substantially greater axle loads in public road traffic than is the case in Germany. The counterweight arrangement can remain on the superstructure here. Now, in order to distribute the axle load as evenly as possible during the road trip, the base plates are designed to be separated from the counterweight arrangement. They are taken up accordingly by transport receptacles provided on the mobile crane. Advantageously, these transport receptacles are provided in the region of the heavily dimensioned areas of the sliding beam box on the undercarriage of the mobile crane.

Advantageously, the stacks of counterweights can be adjusted at different counterweight radius, i.e., one tower stands at 7 m outer radius, for example, the other at 5 m outer radius. Since each stack of counterweights has its own swivel arm, this independent adjustment is possible.

Other features, details and benefits of the invention will be explained more closely with the help of the sample embodiments represented in the Figs.

BRIEF DESCRIPTION OF FIGURES

FIG. 7 shows a representation of the removed counterweight arrangement, which has been loaded onto a low loader for transport.

DETAILED DESCRIPTION

Figure 1:
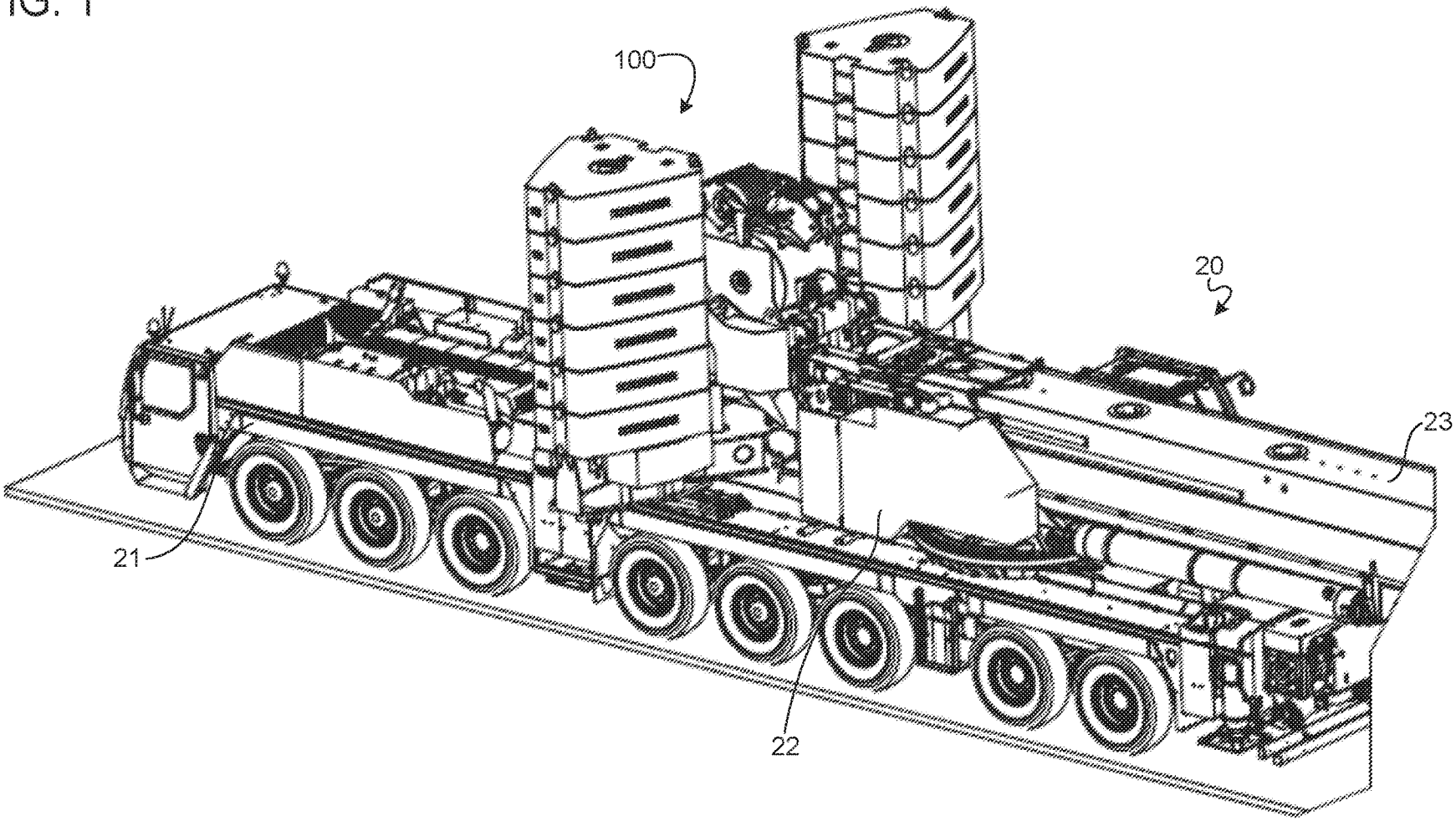
FIG. 1 shows a perspective representation of a mobile crane according to the present invention with counterweight arrangement with medium ballast radius arranged on the superstructure.
Figure 11:
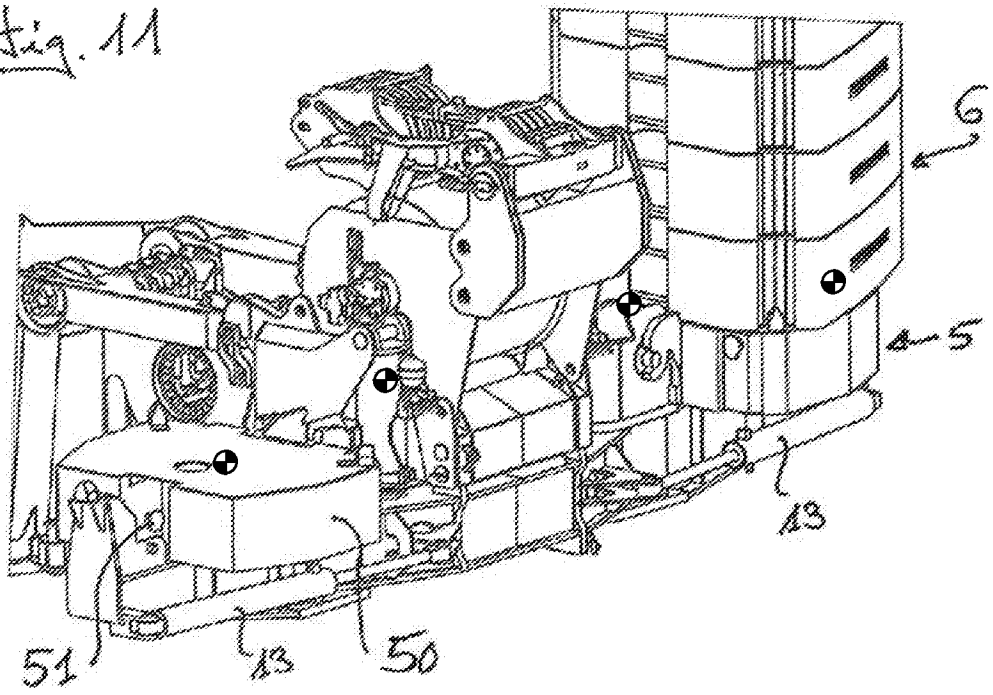
FIG. 11 shows a further detail representation of the mobile crane of the present invention to illustrate the holding of the base plate on the counterweight arrangement.

FIG. 1 shows a mobile crane 20 in perspective representation, having in usual fashion an undercarriage 21 and mounted thereon a rotating superstructure 22. On the superstructure is mounted a jib 23 about a tilt axis (not shown). Furthermore, a counterweight arrangement 100 is disposed on the superstructure 22. This counterweight arrangement 100 is removable in design. In the removed state, the counterweight arrangement 100 is shown in FIG. 7, being placed there on a low loader 3 for road transport. The overall counterweight arrangement 100 has first of all a counterweight base plate 1, which is connected to a counterweight frame 2. By the counterweight frame 2, the entire counterweight arrangement 100 is suspended from and bolted to the superstructure 22. On the counterweight base plate 1 there are swivel arms 5 each pivoting about a vertical bearing 12. On the swivel arms there are formed stacks of counterweights 6, formed by counterweight plates 4. As is especially seen in FIGS. 4 and 11, the swivel arms 5 are pivoted by hydraulically operated piston and cylinder arrangements 13.

Figure 2:
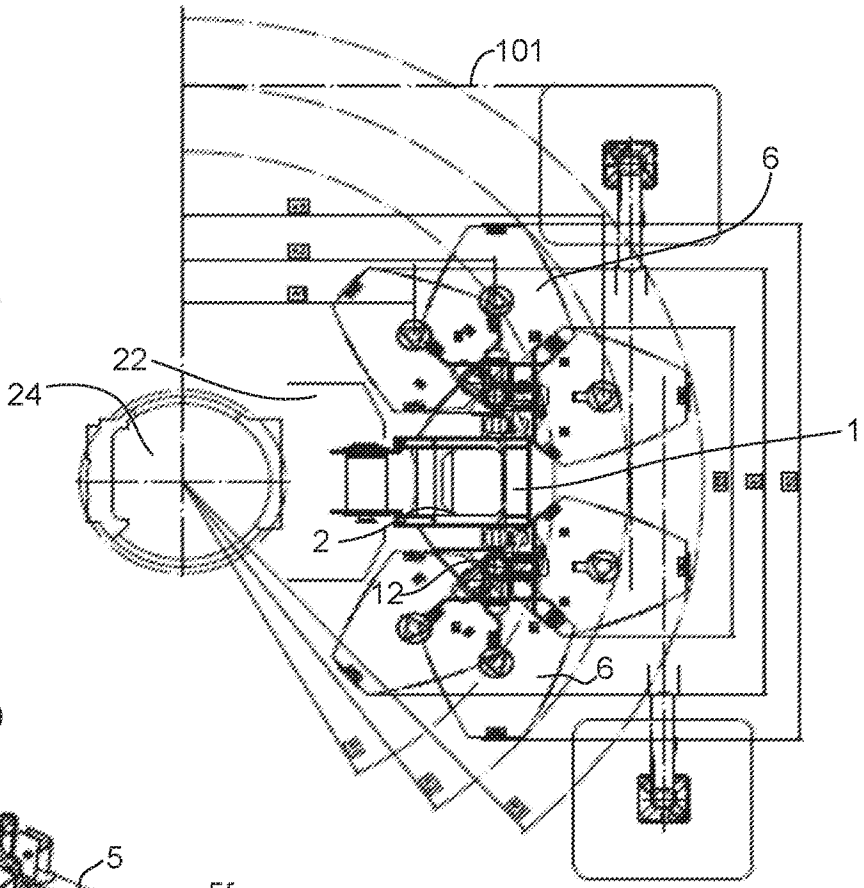
FIG. 2 shows a top view of the counterweight arrangement in different swivel positions to illustrate the swivel radii of the superstructure in dependence on the position of the stacks of counterweights.
Figure 5:
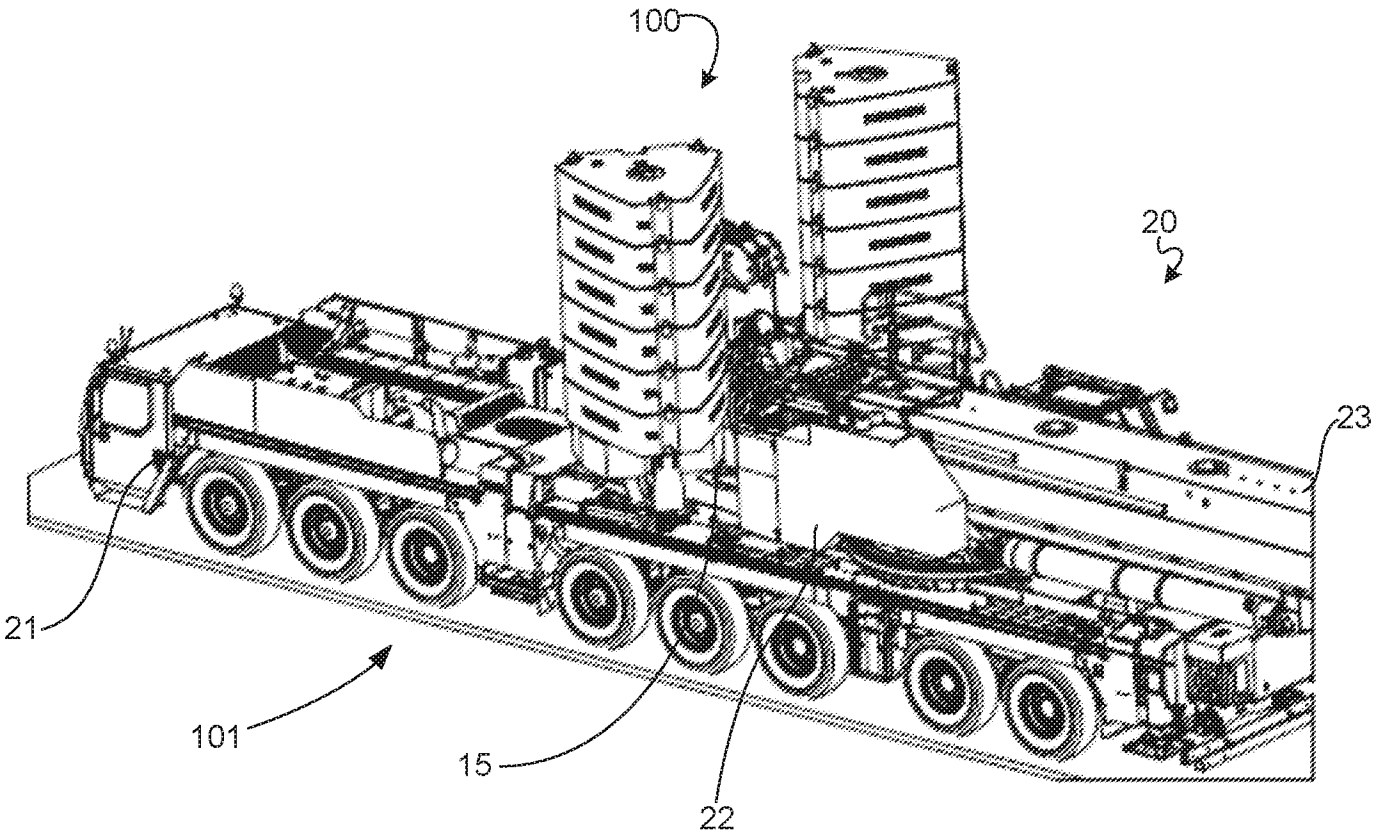
FIG. 5 shows a representation of the mobile crane corresponding to FIG. 1 with small ballast radius.
Figure 6:
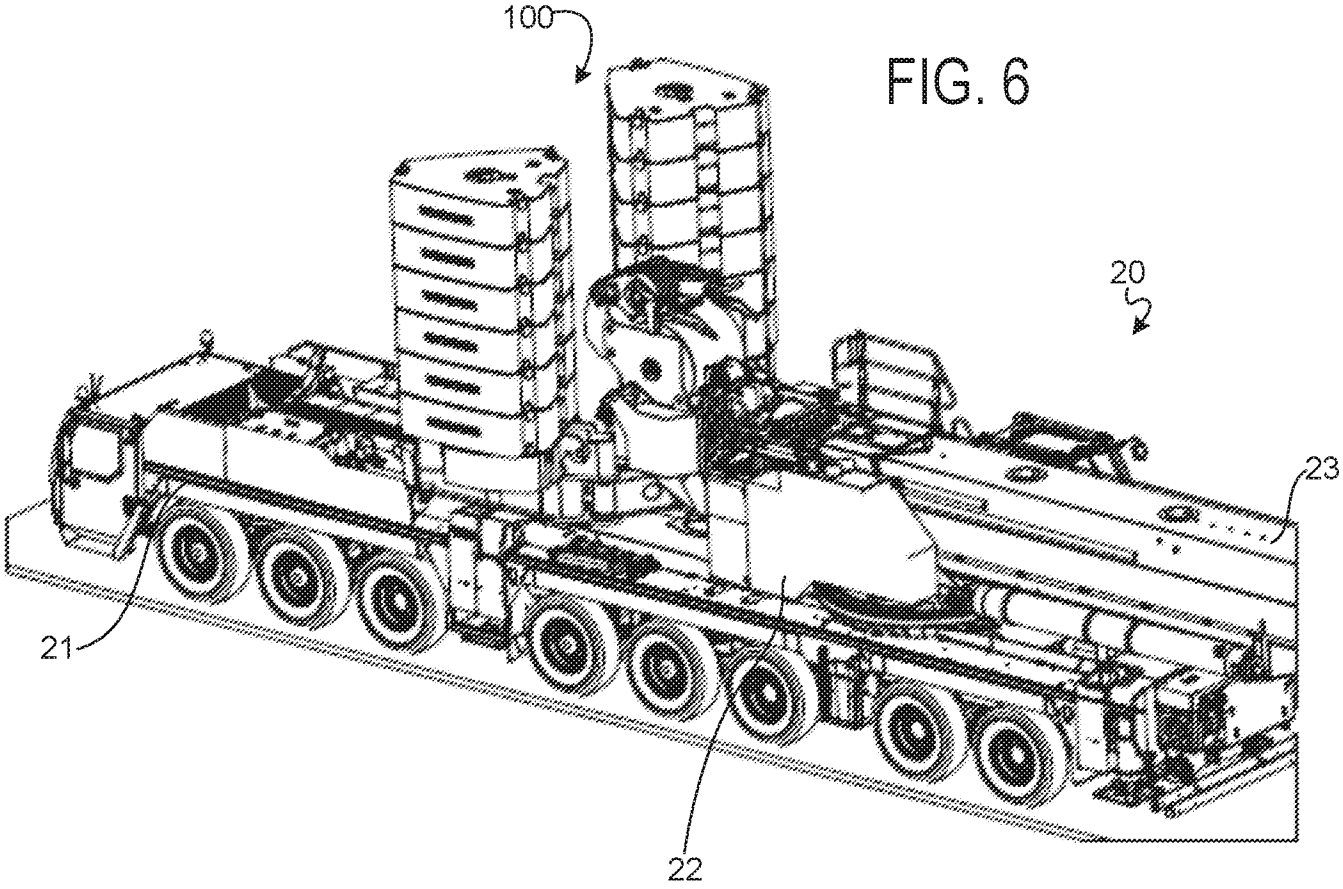
FIG. 6 shows a representation of the mobile crane corresponding to FIG. 1 with large ballast radius.
Figure 17:
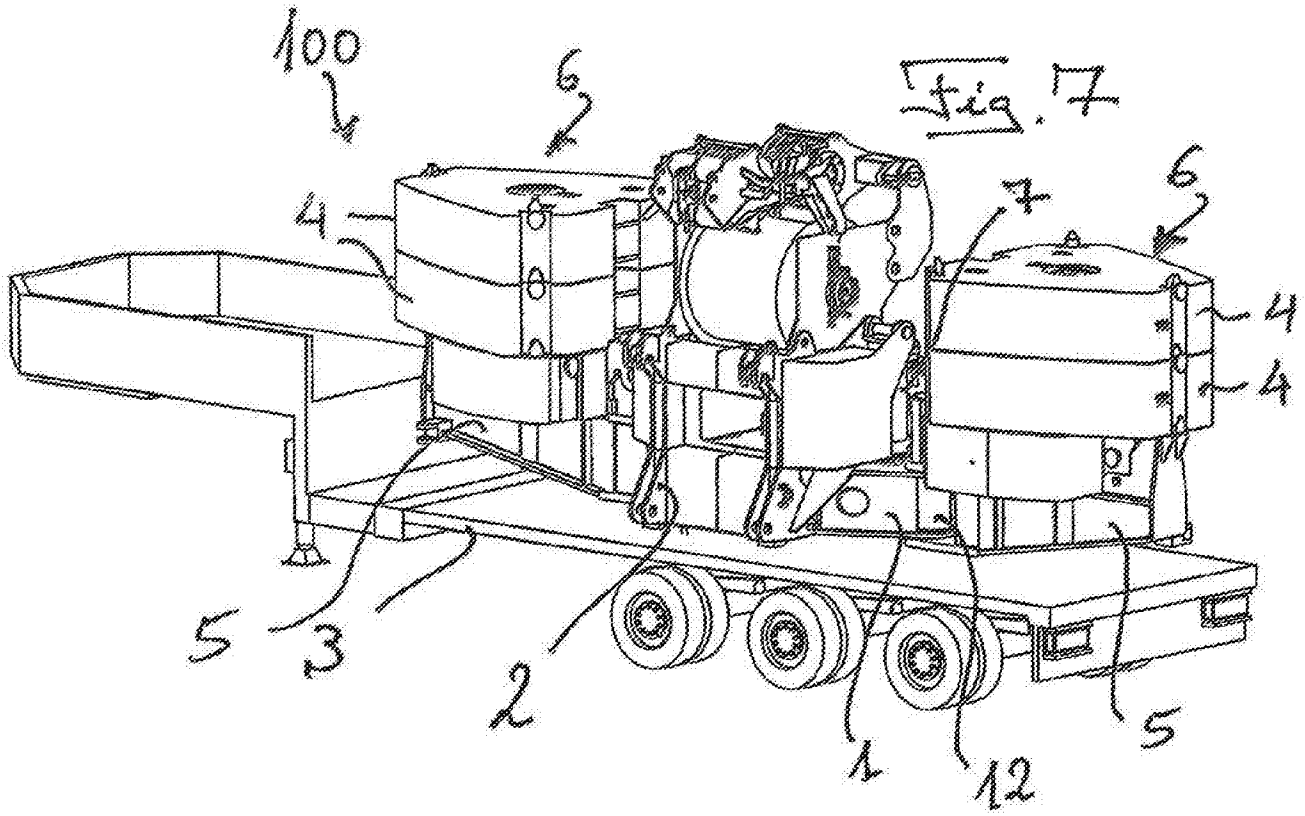

In the top view of FIG. 2 it is shown how the individual stacks of counterweights 6 are swiveled into different swivel positions about the vertical bearing 12. The counterweight plates have an essentially triangular base surface, the respective corners being trimmed from the basic triangle. This is shown, for example, in the top view of FIG. 2. Depending on the degree of swiveling, on the one hand the countertorque generated by means of the counterweight arrangement is increased or decreased. As can be seen by means of the swept radii R1, R2 and R3, the swivel radius of the superstructure is correspondingly decreased or increased. In this way, by appropriate swiveling of the stacks of counterweights 6, the counterweight distance from the pivot point of the rotary bearing 24 is continuously adjusted. In the solid bold line, the stacks of counterweights 6 are shown in a position in which they sweep a medium ballast radius R2. This corresponds to the arrangement shown in perspective view in FIG. 1. In the less thick line, the ballast stacks 6 are shown swiveled to the large radius R3. This corresponds to the perspective representation per FIG. 6. In likewise less thick line, the ballast stacks are also shown in fully reduced position, where only the radius R1 is swept. This representation is shown in perspective view in FIG. 5.

As already mentioned above, the stacks of counterweights 6 can be adjusted continuously to the required ballast radius R1 to R3 by means of dual-acting hydraulic piston and cylinder units 13. With a sufficient upright torque, the ballast radius R1 can be adjusted. In this swivel state, the stacks of counterweights 6 can be swiveled past interference edges. Especially in the case when the mobile crane 20 can be set up with any desired support base 101, it can thus be operated advantageously on tight construction sites close to interference edges, such as the walls of houses. It is of special benefit here if the corresponding position of the stacks of counterweights 6 is sent by sensors 15 to a control system, such as is basically known from DE 10 2012 006 494 B4.

The entire counterweight arrangement 100 can be mounted here in easy manner on the superstructure 22 of the mobile crane 20 by the following steps:

The low loader 3 (see FIG. 7) carrying the counterweight arrangement 100 drives up to the mobile crane 20 (see FIG. 1).

The braced mobile crane 20 picks up by its own jib 23 the counterweight arrangement 100 and sets it down on the familiar and not otherwise represented positioning devices on the undercarriage 21.

The superstructure 22 turns close to the connection position with the counterweight frame 2. After this, the connection of the power and control lines between the superstructure 22 and the counterweight arrangement 100 is made.

The two ballasting cylinders 7 (FIGS. 7 and 9), whose center of gravity lies in a plane with the centers of gravity of the stacks of counterweights 6, extend and lift up the counterweight frame 2. Thus, the connection sites on the superstructure 22 have freedom to turn further. The counterweight base plate 1 thus stands with the counterweight plates 4 on the superstructure 22 and prevents a tilting of the counterweight arrangement 100.

The superstructure 22 turns with its connection elements, not otherwise shown here, to the connection position.

The ballasting cylinders 7 retract again, until the first connection elements 8 strike against the mating connection elements 9. Upon further retraction of the ballasting cylinders the counterweight base plate 1 with the counterweight plates 4 lifts off from the undercarriage 21 and brings it into a position in which it can be bolted to the counterweight frame 2.

Figure 10:
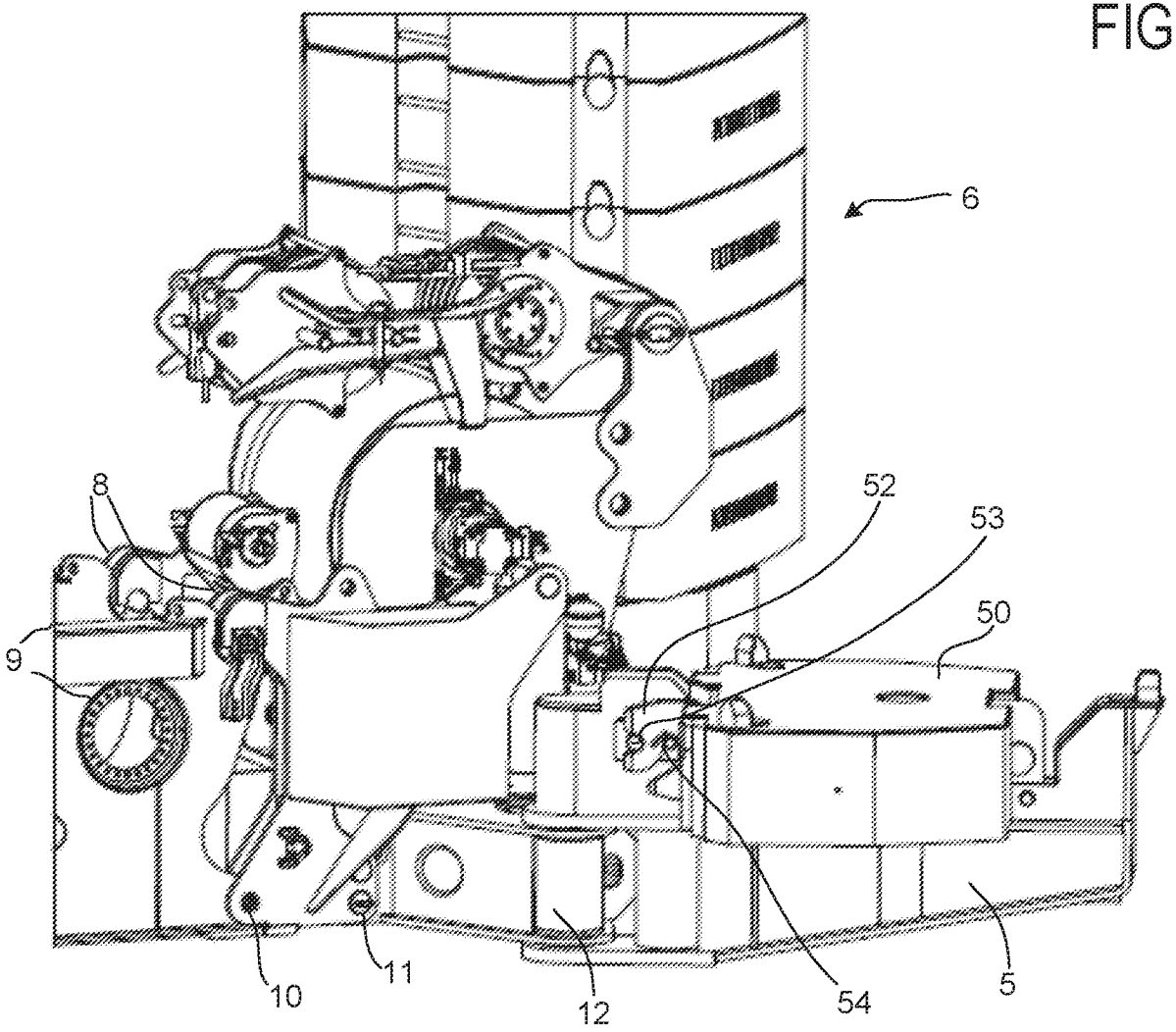
FIG. 10 shows a detail representation of the mobile crane of the present invention to illustrate the holding of the base plate on the counterweight arrangement.

Now the second connection elements 10 between the counterweight frame 2 and superstructure 22 and the connection elements 11 between counterweight frame 2 and counterweight base plate 1 can be made (see FIG. 10).

Finally, the further electrical, hydraulic and/or data exchange connections can be made.

The aforementioned installation procedure can be modified as follows in the context of the invention, where the first two steps of the procedure remain unchanged:

The low loader 3 (see FIG. 7) carrying the counterweight arrangement 100 drives up to the mobile crane 20 (see FIG. 1).

The braced mobile crane 20 picks up by its own jib 23 the counterweight arrangement 100 and sets it down on the familiar and not otherwise represented positioning devices on the undercarriage 21.

The superstructure 22 turns until it is in connection position with the counterweight frame 2 and the counterweight base plate 1. After this, the connection of the power and control lines between the superstructure 22 and the counterweight arrangement 100 is made.

The two ballasting cylinders (FIGS. 7 and 9), whose center of gravity lies in a plane with the centers of gravity of the stacks of counterweights 6, extend and lift up the counterweight frame 2 with the entire stack of counterweights 6 and the optionally mounted winch (with or without adjustment case), until the connection elements 10 between superstructure 22 and the counterweight frame 2 or the counterweight base plate 1 have reached their connection position and the connection can be made.

The ballasting cylinders 7 retract once more and lift up the support plate 200, which was braced against the undercarriage.

If need be, the support plate 200 is protected against accidental lowering.

Figure 3:
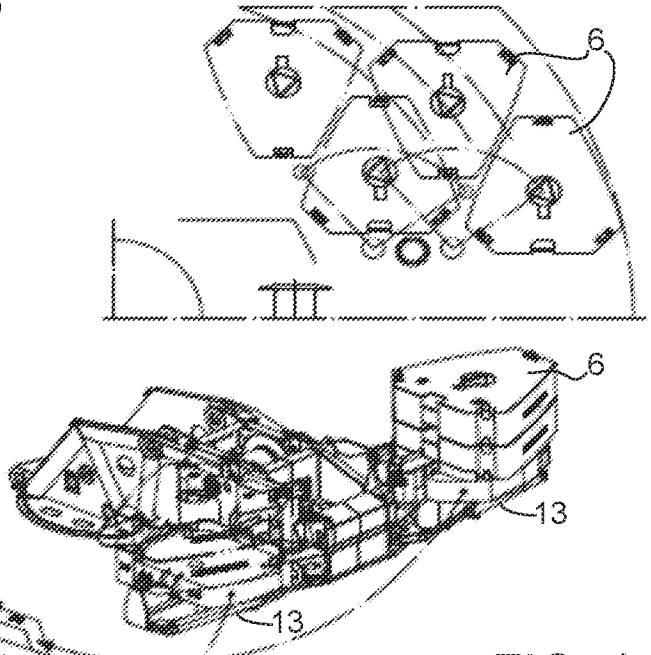
FIG. 3 shows a schematic arrangement of two stacks of counterweights arranged alongside each other according to another embodiment of the invention.

In the embodiment represented in FIGS. 1 and 2, two opposite swivel arms 5 are shown, each able to swivel about a vertical bearing 12. Now, if more counterweight plates 4 are needed, the stack of counterweights 6 may become too tall overall. In this case, according to another variant embodiment, which is represented schematically in FIG. 3, two stacks of counterweights 6 are arranged on each side. In FIG. 3, only one side is shown with the two parallel stacks of counterweights 6. In order to lower the bearing forces and better absorb the then resulting moment of torsion, two vertical bearings 12 and two swivel arms 5 are used here on either side. The stacks of counterweights 6 here are guided by appropriate coupling as a kind of parallelogram.

Finally, yet another alternative embodiment of the invention is shown in FIGS. 4 and 8 to 11. This makes provision for the following circumstance. A mobile crane 20 which is provided for a method in public road transport in Germany must be designed with a uniform axle load of 12 tons. In other countries, such as England, on the other hand, one may travel in public road traffic with substantially larger axle loads. Crane drivers are eager to take advantage of this benefit by carrying along several subassemblies with the crane in road transport. Then these subassemblies do not have to be mounted once again at the construction site. The separate transport by a low loader 3 is also eliminated. The counterweight arrangement 100 according to the invention is designed accordingly by the variant embodiment shown here. It can remain on the superstructure 22 during road transport (see FIG. 4). In order to distribute the axle load evenly, a base plate 50 is then provided on each of the swivel arms 5. The base plates 50 are locked in a quickly removable manner to the supporting swivel arm 5. For this, the mobile crane 20 itself picks up the base plate 50 at a receptacle 51 and lifts it up. In this process, the receptacle 51 lifts off from the swivel arm 5 and turns about a bolt 53. When a nearly vertical position is reached, a latch stud 54 releases a locking plate 52. The base plate 50 can be removed and placed in its transport position 55 on the undercarriage.

Figure 4:
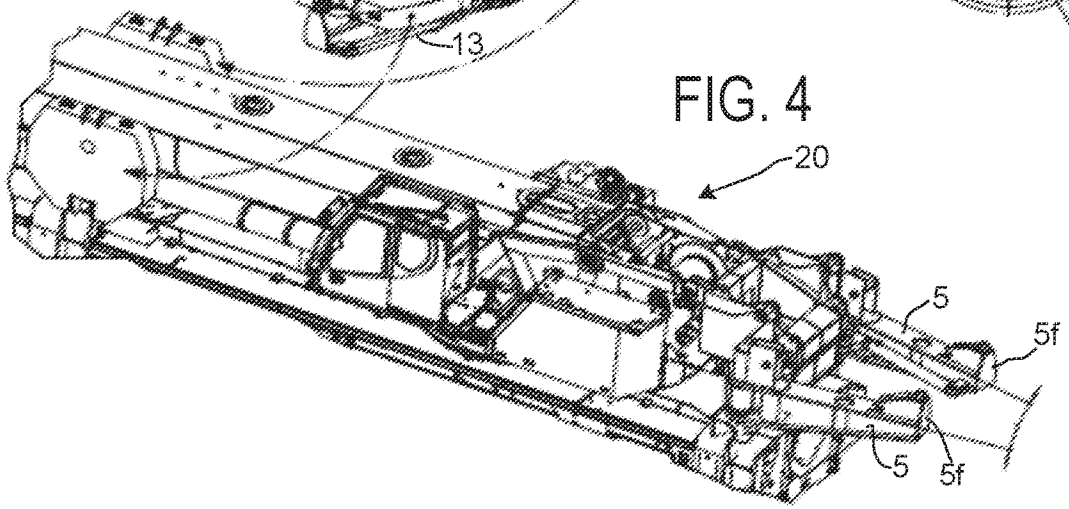
FIG. 4 shows a schematic representation to illustrate the positioning of the base plate of the counterweight arrangement during road travel of the mobile crane.

In advantageous manner, the transport position 55 is provided on the appropriately heavily dimensioned areas of the sliding beam box 56 on the undercarriage 21. In order to comply with the permitted vehicle width, a vertically oriented transport of the base plate 50 is required. Of course, an appropriate transport securement is provided, especially to prevent a tipping over of the base plate 50, in a manner not otherwise shown here. In FIG. 4 as well as FIGS. 8 and 9 the base plates 50 are shown each time in the transport position 55.

Figure 8:
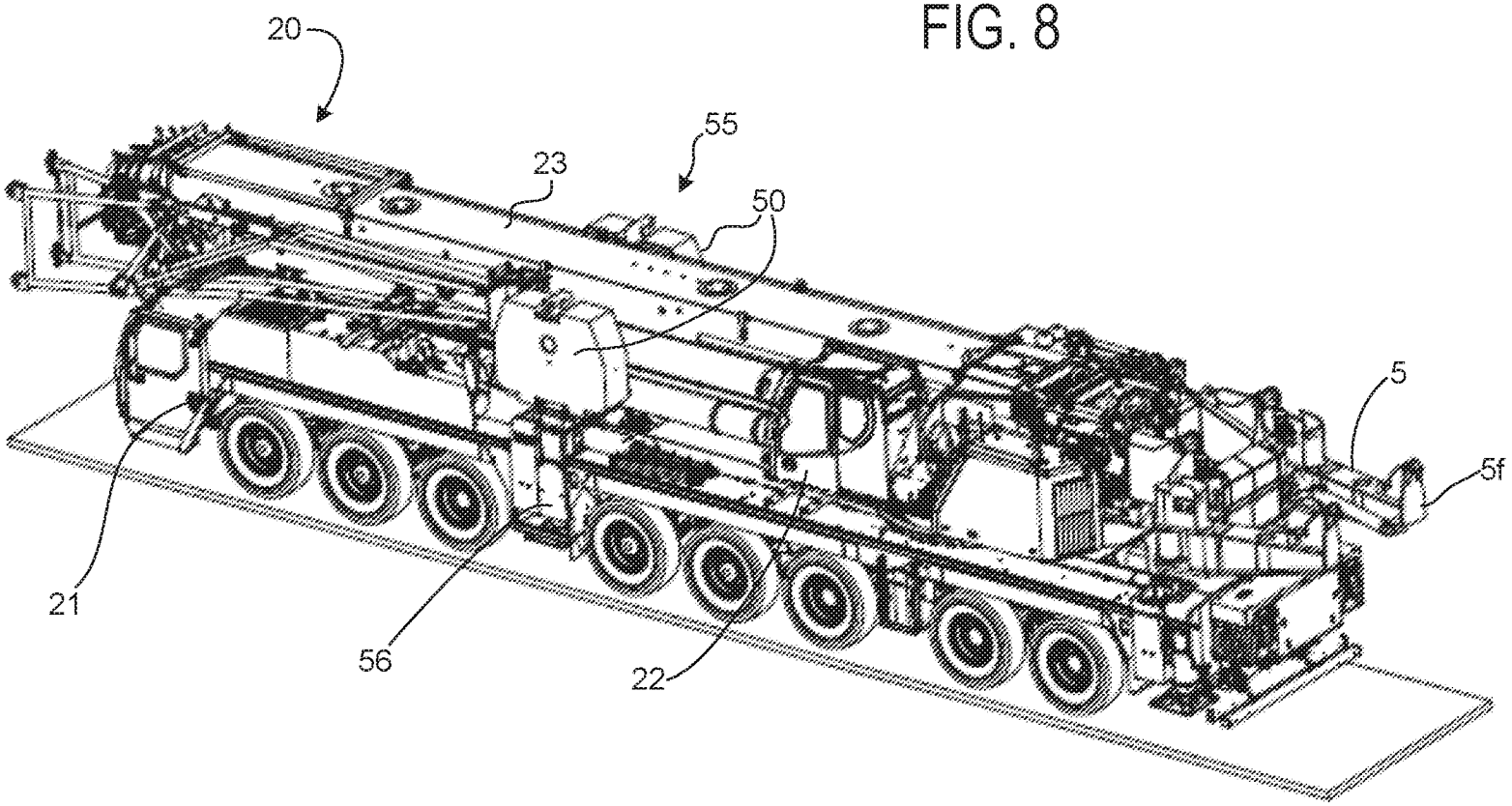
FIG. 8 shows a mobile crane according to one embodiment of the present invention, in the travel state with increased axle load according to FIG. 4.
Figure 9:
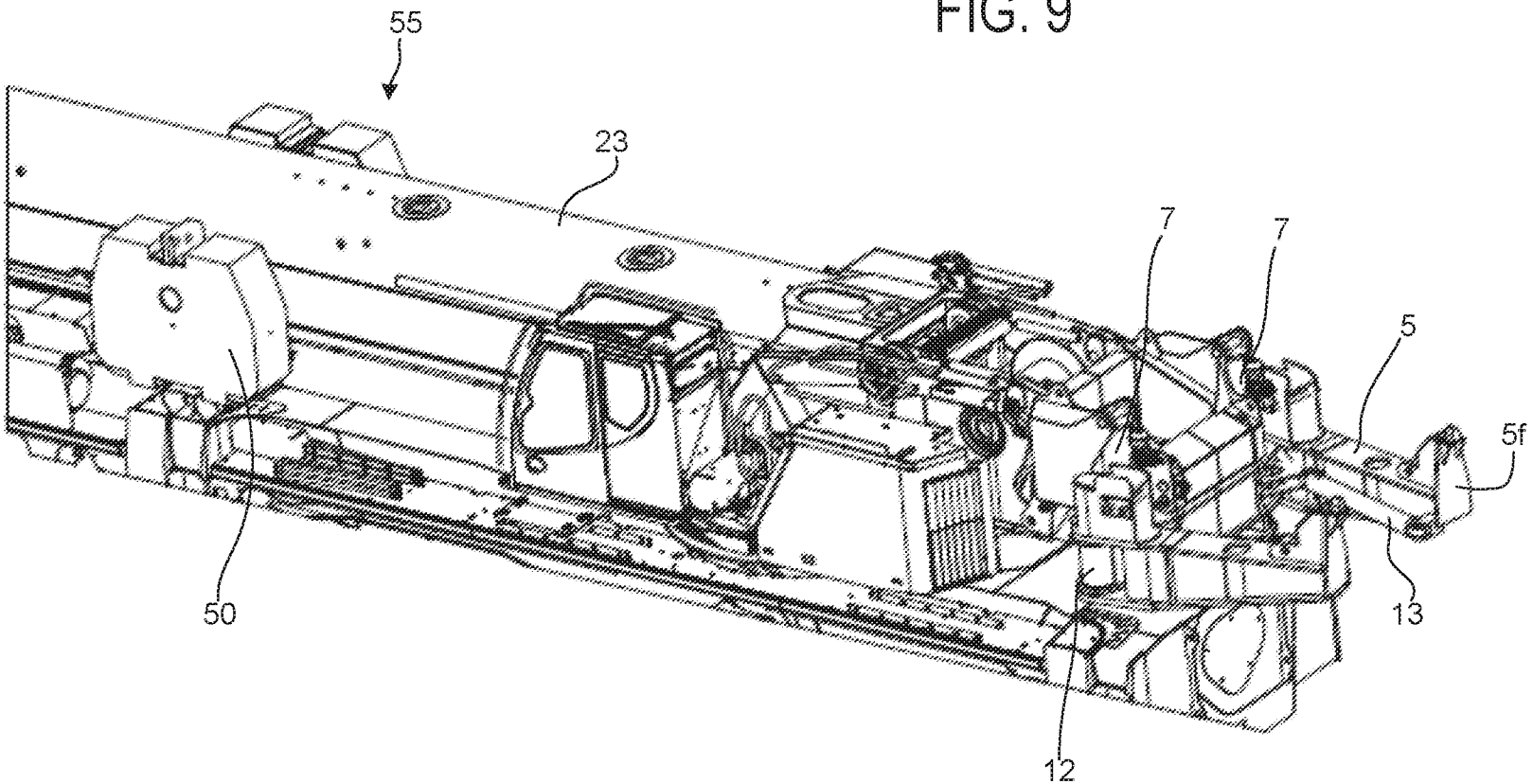
FIG. 9 shows a detail representation of the mobile crane of the present invention.

The swivel arms 5 project beyond the rear end of the mobile crane 20, as shown in FIG. 4. This swing-out is a relevant dimension in road travel. In order to comply with the geometrical requirements for the swinging out, the swivel arms 5 at their free ends 5*f* can move far enough in the direction of the lengthwise axis of the mobile crane 20, as is represented in FIGS. 4, 8 and 9.

The two subassemblies, counterweight base plate 1 and counterweight frame 2, can be a combined subassembly.

Figure 12:
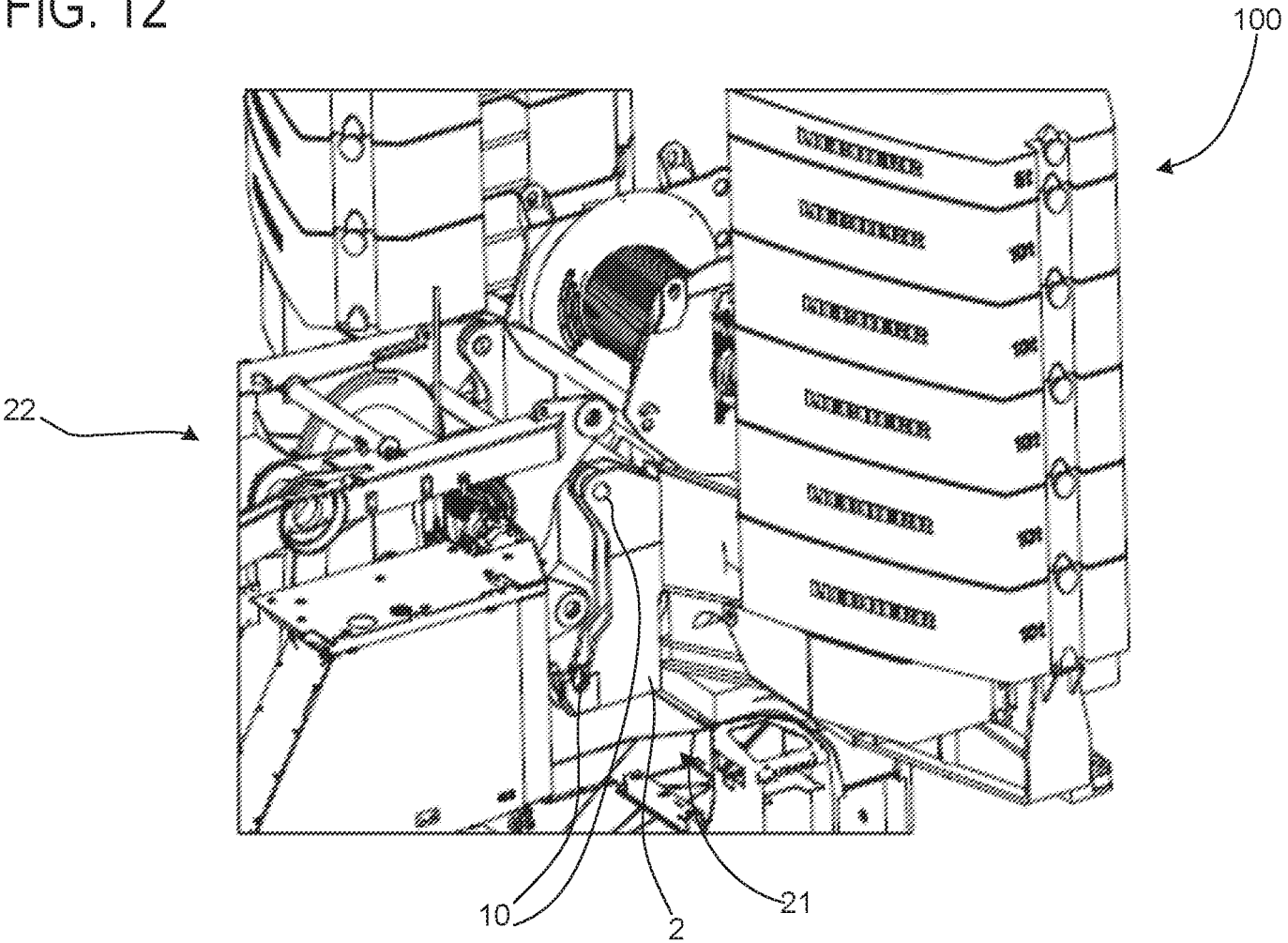
FIG. 12 shows a perspective detail representation, in which the ballast has been removed prior to bolting with the superstructure on the sliding beam box.

The counterweight arrangement 100 can be placed at a suitable position of the undercarriage before it is mounted on the superstructure 22. This suitable position can lie on the sliding beam box, especially the rear sliding beam box (see FIG. 12). The sliding beam box can then direct the gravity force of the counterweight arrangement 100 directly into the ground via the bracing, without overloading the vehicle frame of the undercarriage and causing it to bend. This results in fewer inaccuracies and the connection elements 10, i.e. the bolts, can be inserted more easily.

The invention claimed is:

1. A mobile crane with a drivable undercarriage and a rotatable superstructure mounted thereon, wherein on one side of the superstructure there is pivoted a swiveling jib, and on another side of the superstructure a counterweight arrangement is mounted which is movable relative to the superstructure, wherein the counterweight arrangement has at least one counterweight base plate, on which at least two stacks of counterweights are arranged, each of the at least two stacks of counterweights able to swivel about a corresponding vertical axis, each corresponding vertical axis located at a different position of the mobile crane, wherein the at least two stacks of counterweights are placed on swivel arms pivoting on a counterweight base plate of the at least one counterweight base plate, wherein the swivel arms swivel continuously from a maximum retracted position to a maximum extended position via swivel drive units, wherein the counterweight arrangement is coupled to the superstructure via a counterweight frame, and wherein ballasting cylinders are positioned between the at least two stacks of counterweights and the counterweight frame, wherein the at least one counterweight base plate and the swivel arms are removable as a whole from the superstructure as a self-standing transport unit, wherein the mobile crane is configured for traveling on public roads, and wherein swivel angles of the swivel arms are detected by sensors.

2. The mobile crane according to claim 1, wherein the at least one counterweight base plate is joined by the counterweight frame to the superstructure.

3. The mobile crane according to claim 2, wherein each of two ballasting cylinders includes a center of gravity, and wherein the centers of gravity of the two ballasting cylinders lie in a plane with centers of gravity of each of the at least two stacks of counterweights.

4. The mobile crane according to claim 3, wherein the ballasting cylinders extend and lift up the counterweight frame.

5. The mobile crane according to claim 1, wherein counterweight plates which are formed into the at least two stacks of counterweights have an essentially triangular shape.

6. The mobile crane according to claim 1, wherein four stacks of counterweights are arranged to swivel about four vertical axes, wherein each time two stacks of counterweights arranged alongside each other are pivotable and coupled together.

7. The mobile crane according to claim 1, wherein the at least one counterweight base plate is also placed already on the counterweight arrangement for transport.

8. The mobile crane according to claim 1, wherein the at least one counterweight base plate arranged on the swivel arms to receive the counterweights is configured to be taken off and fastened on the mobile crane.

9. The mobile crane according to claim 8, wherein the at least one counterweight base plate for transport is arranged on a sliding beam box of the undercarriage during the road transport of the mobile crane.

10. The mobile crane according to claim 8, wherein the at least two stacks of counterweights are adjustable to a different counterweight radius independent of each other.

11. The mobile crane according to claim 1, wherein the swivel drive units are in the form of hydraulically operated piston and cylinder arrangements.

12. The mobile crane according to claim 1, wherein a vertical bearing forms the corresponding vertical axis for each of the at least two stacks of counterweights.

13. The mobile crane of claim 12, wherein each of the at least two stacks of counterweights further include a swivel arm of the swivel arms that pivots about the vertical bearing forming the corresponding vertical axis.

14. A mobile crane with a drivable undercarriage and a rotatable superstructure mounted thereon, wherein on one side of the superstructure there is pivoted a swiveling jib, and on another side of the superstructure a counterweight arrangement is mounted which is movable relative to the superstructure, wherein the counterweight arrangement has at least one counterweight base plate, a first counterweight base plate having a first stack of counterweights and a second stack of counterweights arranged thereon, wherein the first stack of counterweights and the second stack of counterweights each have a center of gravity, wherein the first stack of counterweights and the second stack of counterweights are able to swivel about a corresponding vertical axis, each corresponding vertical axis located at a different position of the mobile crane, wherein the at least one counterweight base plate is joined by a counterweight frame to the superstructure, wherein a first ballasting cylinder and a second ballasting cylinder each include a center of gravity, and wherein the center of gravity for each of the first ballasting cylinder, the second ballasting cylinder, the first stack of counterweights, and the second stack of counterweights lies in a plane.

15. The mobile crane of claim 14, wherein the center of gravity for each of the first ballasting cylinder, the second ballasting cylinder, the first stack of counterweights, and the second stack of counterweights results in four total centers of gravity that lie in the plane.

* * * * *